US009543699B1

(12) United States Patent
Wang et al.

(10) Patent No.: US 9,543,699 B1
(45) Date of Patent: Jan. 10, 2017

(54) CONNECTOR ASSEMBLY WITH BIDIRECTIONAL CLAMPING STRUCTURE

(71) Applicant: Amphenol LTW Technology Co., Ltd., New Taipei (TW)

(72) Inventors: Jun Wang, New Taipei (TW); Chih-Wen Hu, New Taipei (TW)

(73) Assignee: AMPHENOL LTW TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 15/150,712

(22) Filed: May 10, 2016

(30) Foreign Application Priority Data

Apr. 8, 2016 (TW) ..... 105111121 A

(51) Int. Cl.

| | |
|---|---|
| ***H01R 4/50*** | (2006.01) |
| ***H01R 13/625*** | (2006.01) |
| ***H01R 13/631*** | (2006.01) |
| ***H01R 13/52*** | (2006.01) |
| ***H01R 13/424*** | (2006.01) |

(52) U.S. Cl.
CPC ..... *H01R 13/631* (2013.01); *H01R 13/424* (2013.01); *H01R 13/521* (2013.01); *H01R 13/5202* (2013.01)

(58) Field of Classification Search
CPC ..... H01R 12/88; H01R 13/629; H01R 13/193; H01R 4/2412; H01R 4/2433; H01R 4/2491; H01R 4/2404
USPC ..... 439/341, 409, 410, 422, 419, 467; 174/117 F
See application file for complete search history.

(56) References Cited

U.S. PATENT DOCUMENTS

| | | | | |
|---|---|---|---|---|
| 5,435,747 | A * | 7/1995 | Franckx | H01R 4/2433 439/409 |
| 6,074,238 | A * | 6/2000 | DeRoss | H01R 12/675 439/409 |
| 6,660,935 | B2 * | 12/2003 | Southard | G09F 9/33 174/50 |
| 6,914,194 | B2 * | 7/2005 | Fan | F21S 4/24 174/117 F |
| 7,442,064 | B2 * | 10/2008 | Miwa | H01R 43/26 439/326 |
| 2005/0064759 | A1 * | 3/2005 | Libby | H01R 4/2412 439/409 |

* cited by examiner

*Primary Examiner* — Hae Moon Hyeon
(74) *Attorney, Agent, or Firm* — Chun-Ming Shih; HDLS IPR Services

(57) ABSTRACT

A connector assembly (100) with a bidirectional clamping structure is used for assembling a light emitting component (10). The connector assembly (100) includes a first pivot member (110) and a second pivot member (200). The first pivot member (110) includes a body (120), a cover (150), a first pivot portion (170) connected to one side of the body (120) and the cover (150), and a wire groove (180) at the other side. The second pivot member (200) is detachably pivotally connected to the first pivot member (110). The second pivot member (200) includes a base (210). The base (210) includes a second pivot portion (220) asymmetrically disposed with respect to the first pivot portion (170) and an insertion slot (260). The insertion slot (260) is provided for insertion of the light emitting component (10) and is disposed corresponding to the other side of the second pivot portion (220).

12 Claims, 8 Drawing Sheets

CONNECTOR ASSEMBLY WITH BIDIRECTIONAL CLAMPING STRUCTURE

TECHNICAL FIELD

The present invention relates to an electrical connector assembly and, in particular, to a connector assembly with a bidirectional clamping structure for connecting a soft light emitting component (e.g. an LED light strip/band).

BACKGROUND

There is a silicone waterproof sealing member in the market, which is used to assemble a light emitting diode (LED) on a band-shaped flexible printed circuit (FPC) board to form a LED strip/bar. The LED strip/bar has a lifespan of 80,000 to 100,000 hours, is environmental friendly, and the sealing member can be cut into a desired shape and extend as desired, so the LED strip/bar is gradually used in various environments for lighting.

The conventional LED strips/bars are usually connected by manual soldering, and then the LED strips/bars are sealed by silicone or other materials after soldering processes. In the manual soldering process, there are quite some difficulties to deal with. For example, silicone of the sealing member has to be removed first before carrying out the soldering process, and consequently, installation is time consuming, and the connection quality is not reliable due to unstable soldering quality. Thus, the connection method has inferior sealing and allows low current only, so it is not suitable for used in environments in need of effective sealing. Furthermore, soldering connection does not permit easy maintenance, so it wastes considerable cost and time for maintenance.

Accordingly, the inventor made various studies to solve the above-mentioned defects, on the basis of which the present invention is accomplished.

SUMMARY

It is an object of the present invention to provide a connector assembly with a bidirectional clamping structure, whereby it is more convenient to clamp a wire in a wire groove and electrically couple a light emitting component, thus ensuring reliability of power delivery.

It is another object to provide a connector assembly with a bidirectional clamping structure, which enhances a waterproof effect.

Accordingly, the present invention provides a connector assembly with a bidirectional clamping structure for assembling a light emitting component. The connector assembly includes a first pivot member and a second pivot member. The first pivot member includes a body, a cover, a first pivot portion connected to one side of the body and the cover, and a wire groove formed at the other side of the body and the cover, wherein the wire groove is disposed corresponding to the first pivot portion. The second pivot member is detachably pivotally connected to the first pivot member, the second pivot member includes a base, the base includes a second pivot portion asymmetrically disposed with respect to the first pivot portion and includes an insertion slot, wherein the insertion slot is provided for insertion of the light emitting component and is disposed corresponding to the other side of the second pivot portion.

According to the present invention, the wire is clamped in the wire groove of the first pivot member by means of the first pivot portion, and the first pivot member covers and insertedly connects the light emitting component of the second pivot member by means of the second pivot portion, so that the electrical power of the wire can be delivered to the flexible printed circuit board of the light emitting component, and thereby the light emitting diode can light up. Accordingly, it is easy and convenient to operate the connector assembly for assembly, replacement, or maintenance of the light emitting component, thus saving time and cost for installation or maintenance.

Furthermore, by means of the hook portion, the first fastener, and the second fastener of the connector assembly, the connection reliability between the wire and the light emitting component is enhanced, thereby ensuring the stability of power delivery.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
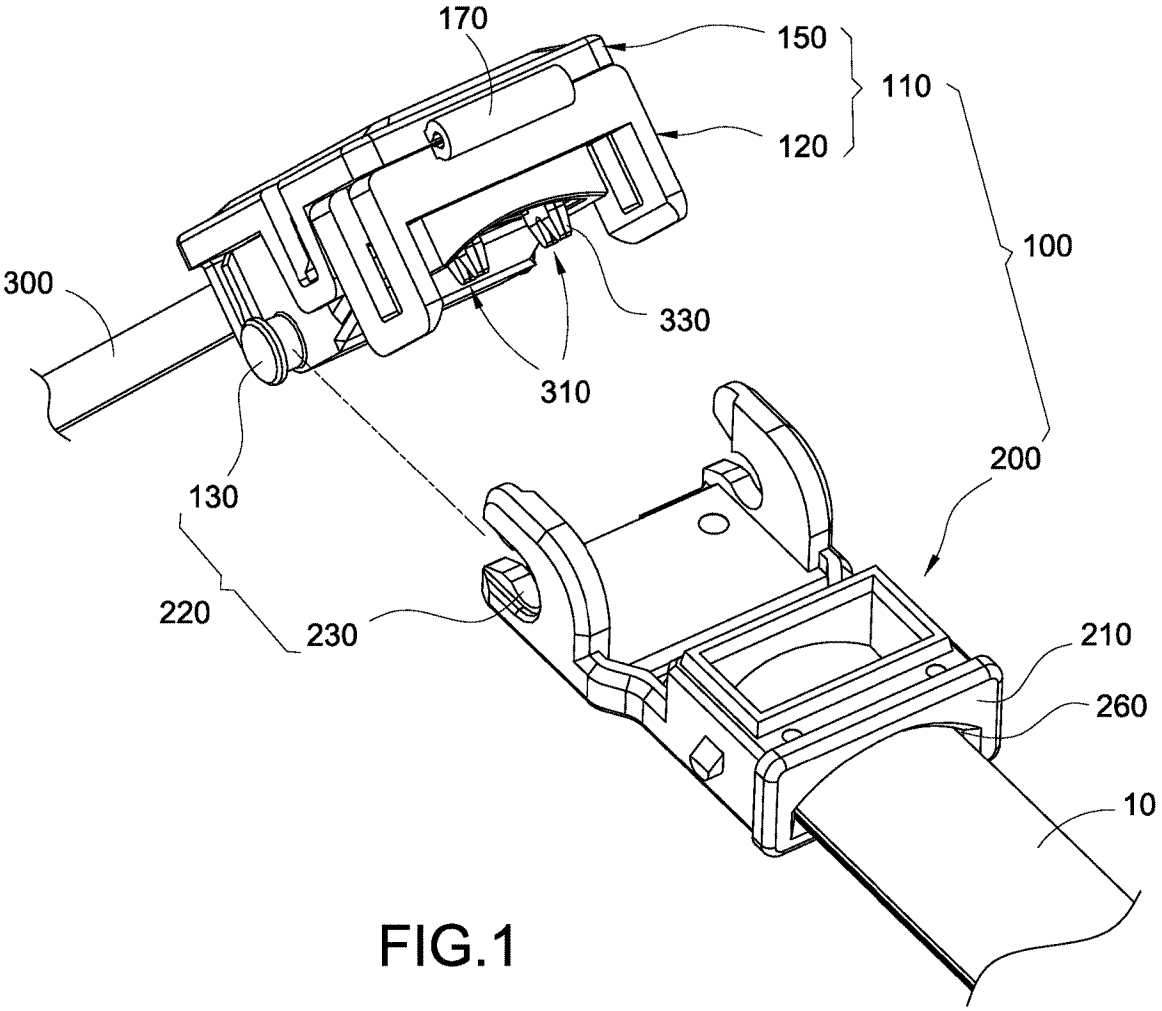
FIG. 1 is a perspective view of the present invention, illustrating a first pivot member and a second pivot member separated from each other.
Figure 2:
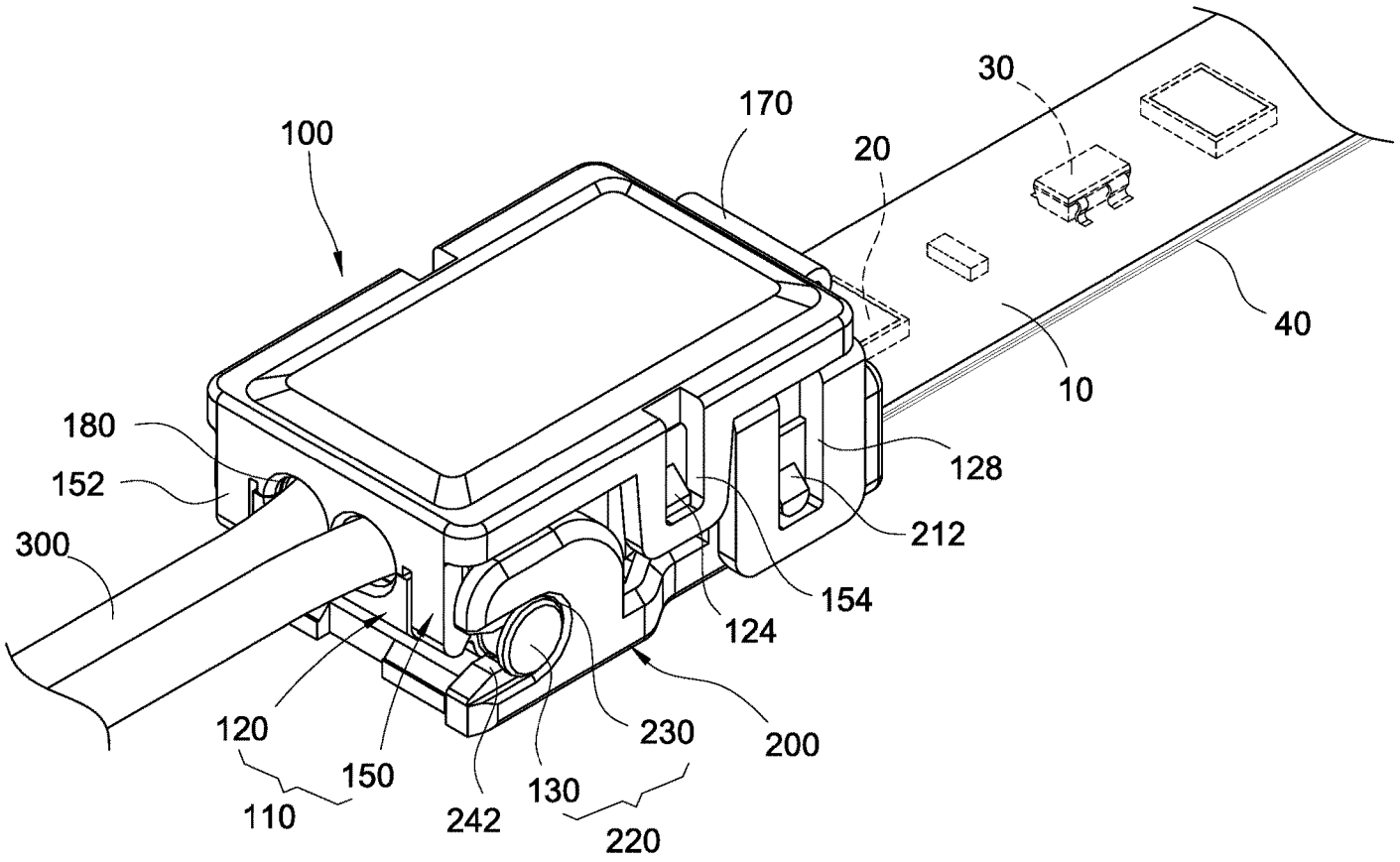
FIG. 2 is an assembled view of the present invention, illustrating a connector assembly with a bidirectional clamping structure.

Referring to FIGS. 1 to 4, the present invention provides a connector assembly 100 with a bidirectional clamping structure for assembling a light emitting component 10. Bidirectional clamping referred herein means that right and left lateral sides, opposite to each other, each have a clamping structure. In the present embodiment, it is preferable that a wire 300 is clamped at one side, and the light emitting component 10 is clamped at the other side, and the wire 300 and the light emitting component 10 are electrically coupled to each other. As shown in FIG. 2, the light emitting component 10 includes a plurality of light emitting diodes (LEDs) 20 and a plurality of driving units 30. Each light emitting diode 20 and each driving unit 30 are electrically coupled to a flexible printed circuit (FPC) board 40. The rest space in the light emitting component 10 contains silicone and/or other materials, so as to form an LED light strip, an LED light band or other related products which can be bent and cut as desired for assembly.

The connector assembly 100 includes a first pivot member 110 and a second pivot member 200. The first pivot member 110 includes a body 120, a cover 150, a first pivot portion 170 connected to one side of the body 120 and the cover 150, and a wire groove 180 formed at the other side of the body 120 and the cover 150, wherein the wire groove 180 is disposed corresponding to the first pivot portion 170. The second pivot member 200 is detachably pivotally connected to the first pivot member 110, and the second pivot member 200 includes a base 210. The base 210 includes a second pivot portion 220 asymmetrically disposed with respect to the first pivot portion 170 and includes an insertion slot 260, wherein the insertion slot 260 is provided for insertion of the light emitting component 10 and is disposed corresponding to the other side of the second pivot portion 220.

Asymmetrical disposal referred herein means that the first pivot portion 170 and the second pivot portion 220 are not on the same horizontal, i.e. an inclined line can be drawn between the first pivot portion 170 and the second pivot portion 220. Moreover, the length between the first pivot member 110 to the first pivot portion 170 can be the same or not the same as the length between the second pivot member 200 to the second pivot portion 220.

The second pivot portion 220 further includes two shafts 130 and two axle holes 230 receiving the two shafts 130, the shafts 130 protrude from two sides of the body 120 respectively, and the two axle holes 230 are formed at two sides of the base 210 respectively. In the embodiment shown in FIGS. 3 and 4, the base 210 further includes two holders 240, each of the axle holes 230 is formed at each of the holders 240, an end portion of each of the holders 240 includes an engagement portion 242 sized smaller than a diameter of the axle hole 230, so that when the shaft 130 of the body 120 is inserted in the axle hole 230, the engagement portion 242 prevents the shaft 130 from separated from the holder 240.

Figure 5:
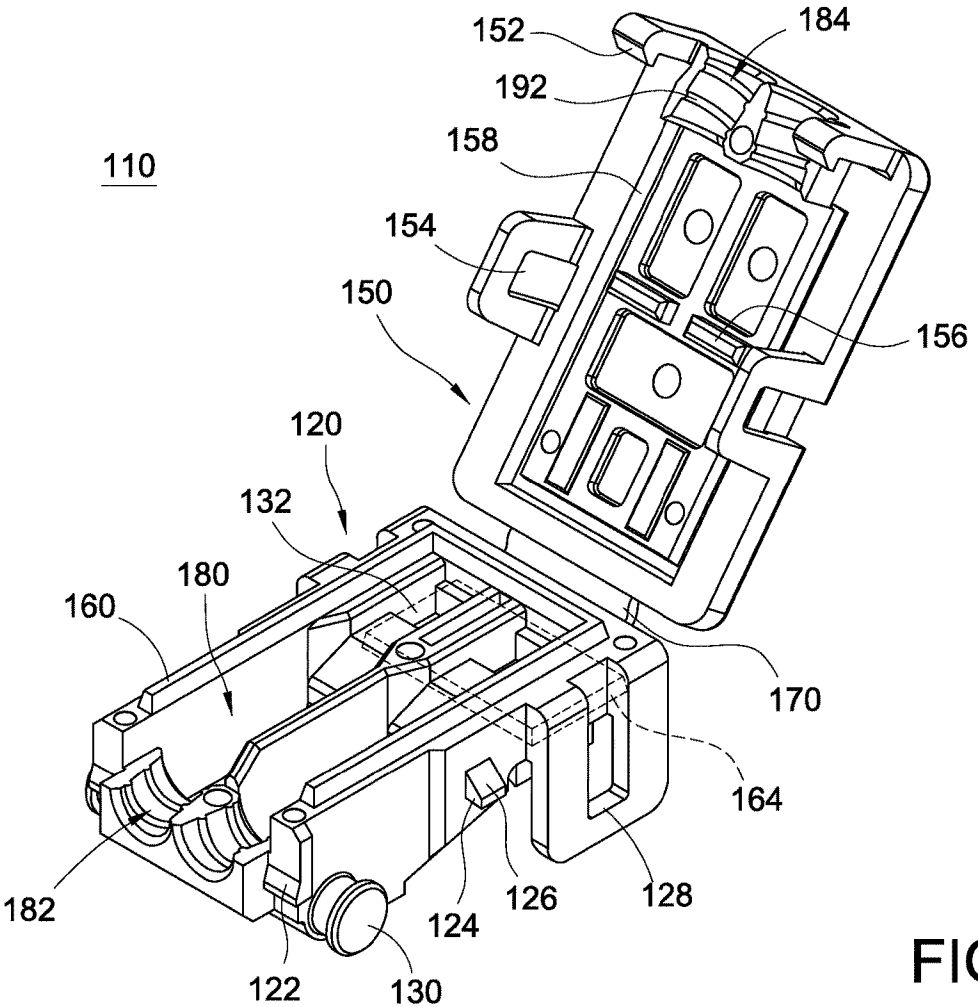
FIG. 5 is a perspective view of the present invention, illustrating the first pivot member is pivoted about a first pivot portion to be in an open configuration.
Figure 6:
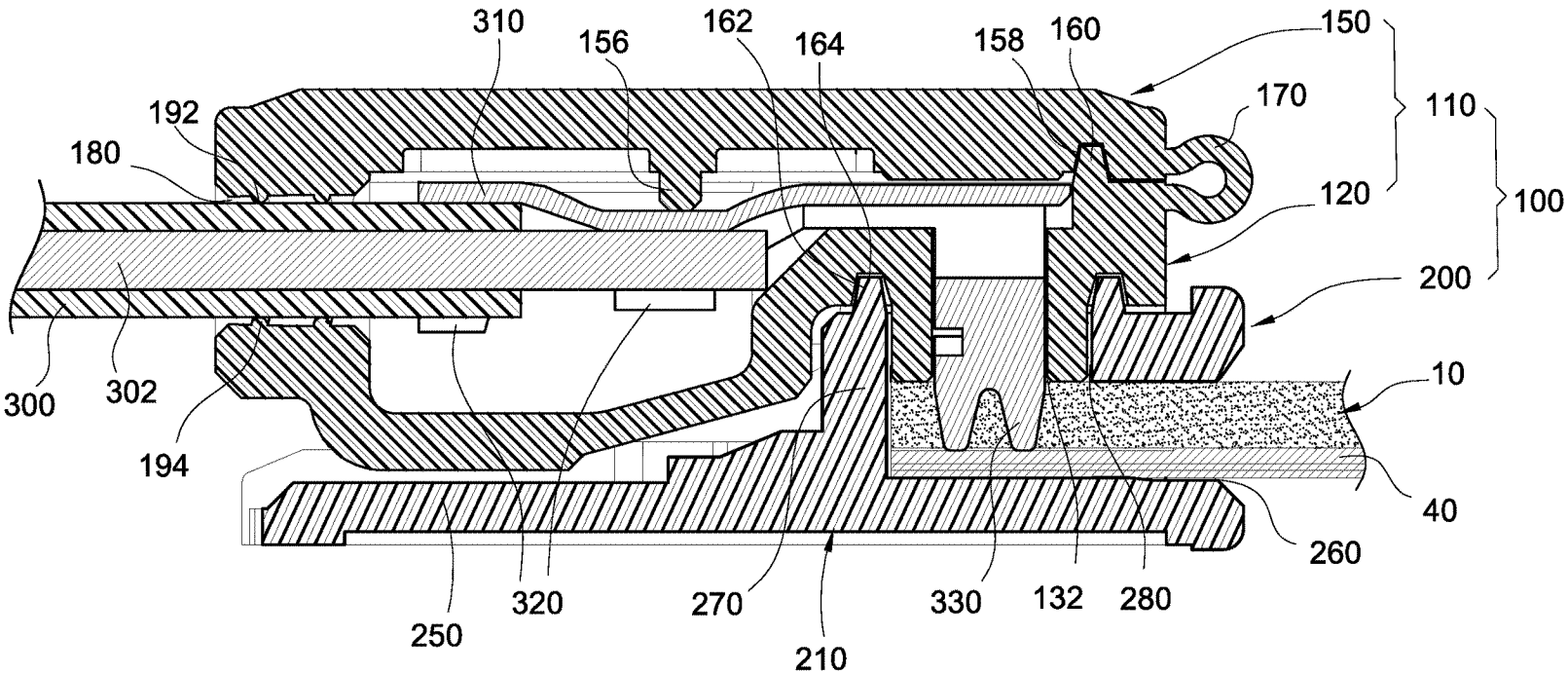
FIG. 6 is a cross-sectional view of the present invention, illustrating the connector assembly with the bidirectional clamping structure.

Referring to FIGS. 5 and 6, the present embodiment further includes two wires 300, each disposed at each of the wire grooves 180, and two conductive terminals 310 clamping the two wires 300. The cover 150 includes two press pillars 156 pressing the two wires 300. For simplicity and for the purpose of describing the present invention, only one wire 300 and its related structure are detailed hereinafter; the present invention is not limited by the particular numbers in the present embodiment.

Figure 7:
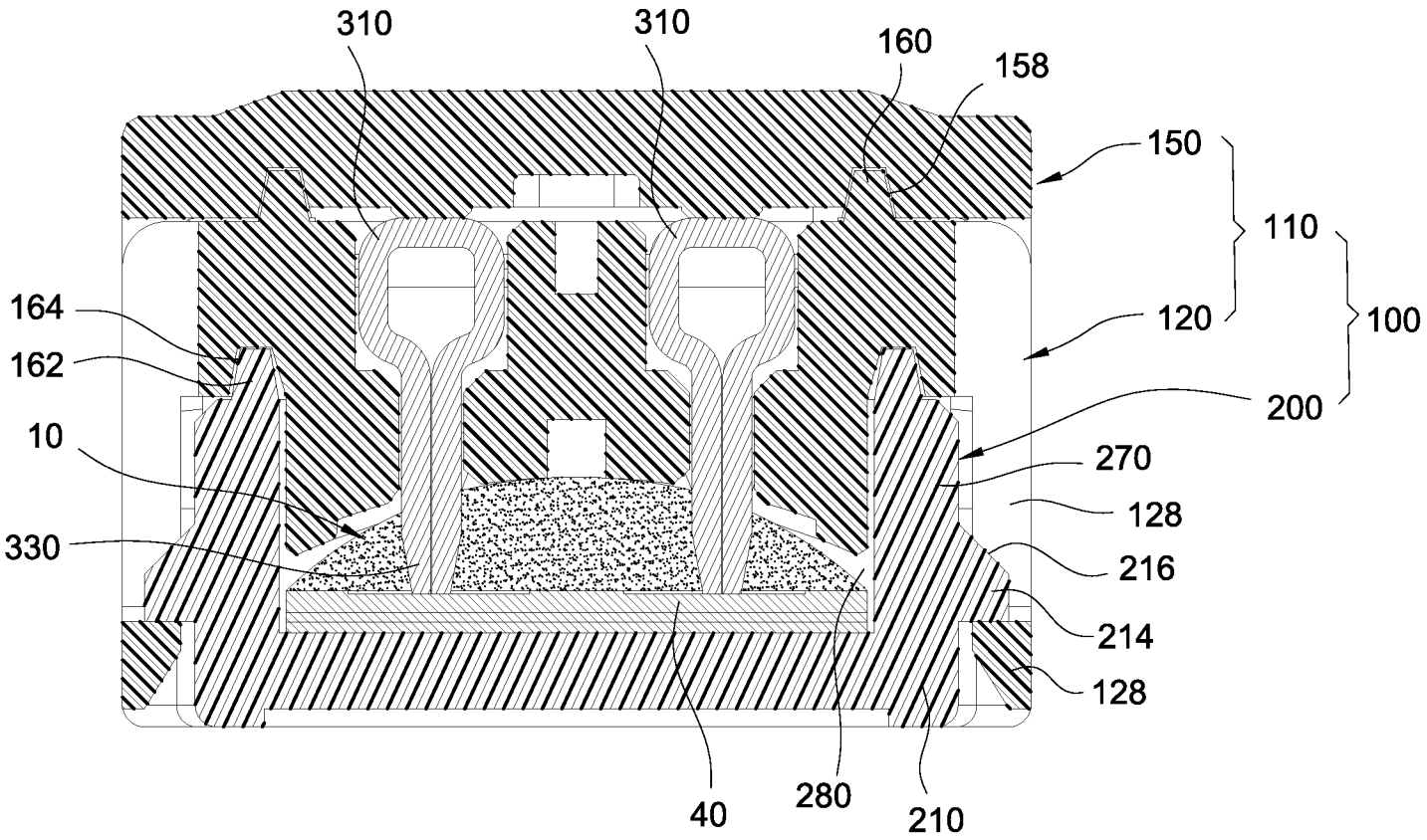
FIG. 7 is a cross-sectional view of the present invention, taken from another viewing angle, illustrating the connector assembly with the bidirectional clamping structure.

As shown in the drawings, the conductive terminal 310 includes two covering portions 320 and a piercing portion 330 protruding from an end portion. Each covering portion 320 covers the wire 300 and a wire core 302 extending from the wire 300. The piercing portion 330 passes through a through hole 132 of the body 120 to pierce the light emitting component 10 so as to be electrically connected to the flexible printed circuit board 40 of the light emitting component 10. That is to say, the piercing portion 330, sharp as a knife, pierces the light emitting component 10 containing silicone inside, and then the conductive terminal 310 delivers electrical power of the wire 300 to the flexible printed circuit board 40 of the light emitting component 10, so that the light emitting diode 20 can light up, as depicted in FIG. 7.

The structure of the connector assembly 100 in the present invention is further detailed as follows. The cover 150 includes a hook portion 152 and a first fastener 154. The body 120 includes a bump 122 engaged with the hook portion 152 and includes a first protrusion 124 engaged with the first fastener 154. The first protrusion 124 has a first inclined surface 126 at one side, so that the first fastener 154 can slide to be engaged with the first protrusion 124, thereby increasing convenience of operation.

The plate-shaped hook portion 152 is disposed at one side opposite to the first pivot portion 170 and serves to rotatably engage and position the wire 300. The first fastener 154 vertically protrudes from a lateral side of the cover 150 and serves to enhance engagement of the cover 150 with the body 120. As shown in the drawing, the first fastener 154 is preferably a plate (not labelled) having an open hole.

When the conductive terminal 310 clamps the wire 300 and accommodates it at the wire groove 180, the user rotates the cover 150 about the first pivot portion 170 as axis, and the cover 150 is engaged with the bump 122 or the first protrusion 124 of the body 120 by means of the hook portion 152 or the first fastener 154, so the wire 300 is clamped in the first pivot member 110 with ease and convenience. On the contrary, when to take out the wire 300, the user simply needs to pull the hook portion 152 or the first fastener 154 to disengage them from the bump 122 or the first protrusion 124 of the body 120, and then the wire 300 can be taken out from the first pivot member 110.

Furthermore, a side surface of the body 120 includes a second fastener 128, and the base 210 includes a second protrusion 212 engaged with the second fastener 128. One side of the second protrusion 212 includes a second inclined surface 214, so that the second fastener 128 can slide to be engaged with the second protrusion 212. As shown in the drawing, the second fastener 128 is also preferably a plate (not labeled) having an open hole, just like the first fastener 154.

Figure 3:
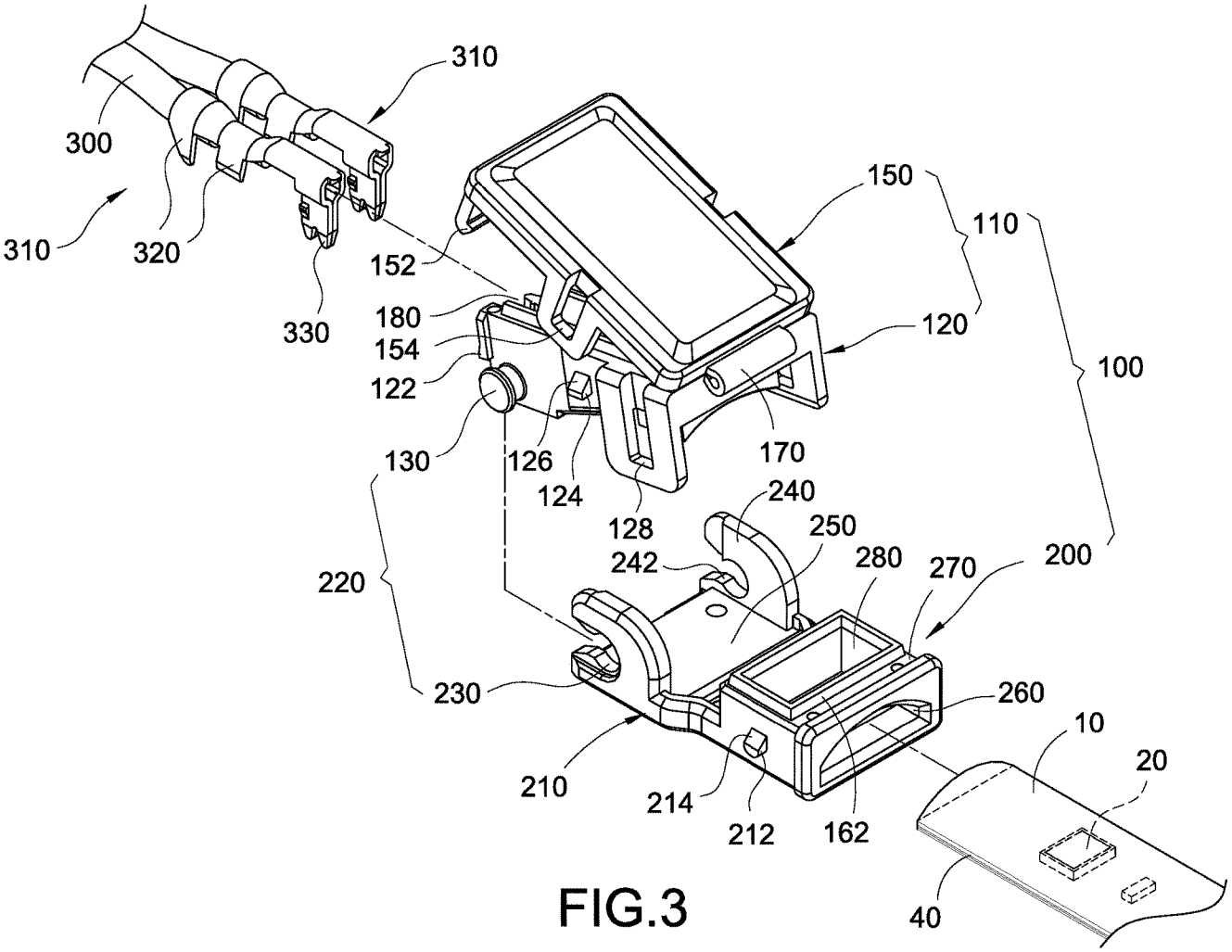
FIG. 3 is an exploded view of the present invention, illustrating the connector assembly with the bidirectional clamping structure.

As shown in FIGS. 3 and 6, the second fastener 128 is preferably disposed at the other side with respect to the shaft 130, and vertically protrudes from the side surface of the body 120, so that the first pivot member 110 can rotate to be engaged with the second pivot member 200. As shown in the drawing, the second fastener 128 is preferably sized greater than the first fastener 154, so as to enhance the engagement between the first pivot member 110 and the second pivot member 200.

Figure 4:
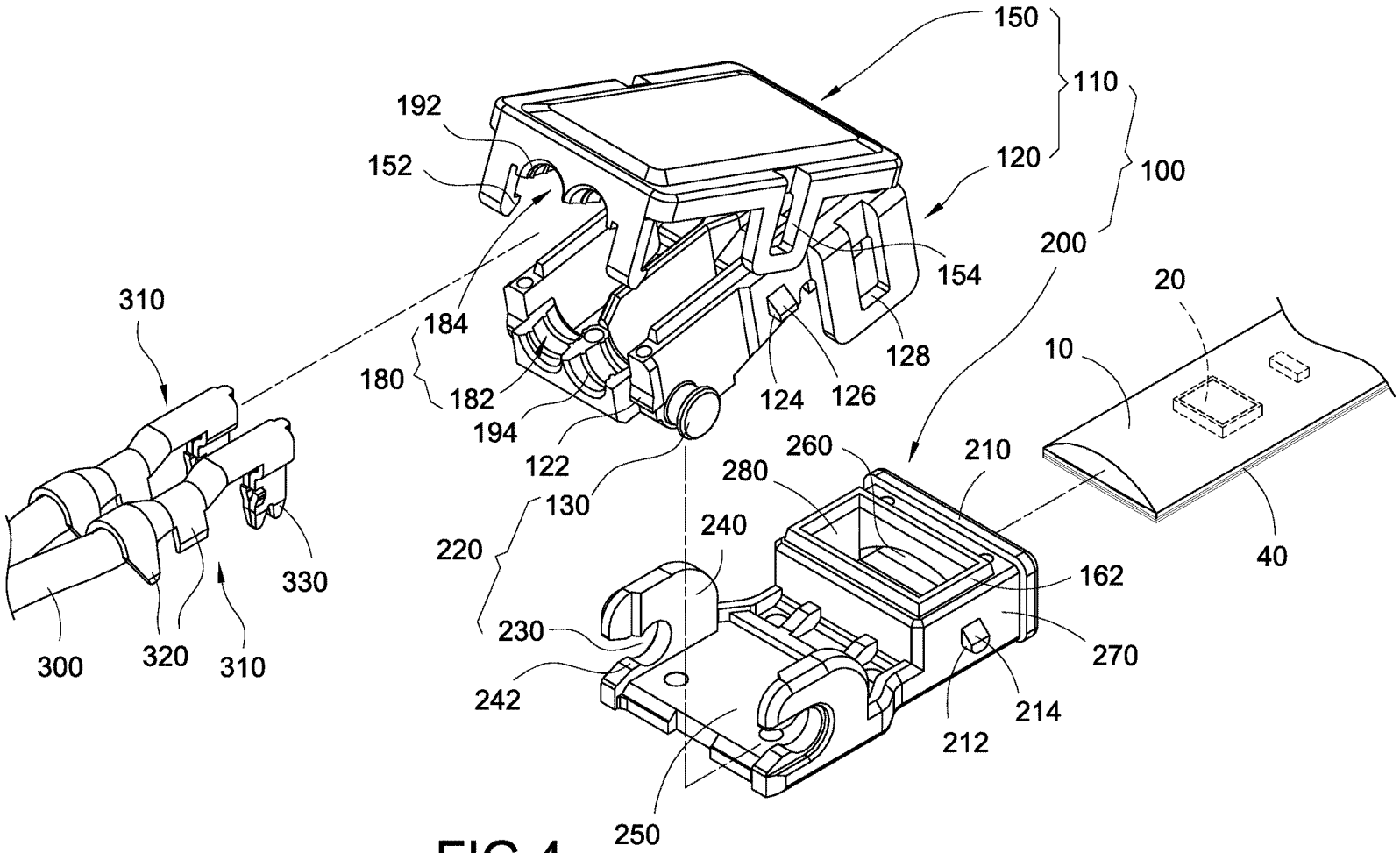
FIG. 4 is an exploded view of the present invention, taken from another viewing angle, illustrating the connector assembly with the bidirectional clamping structure.

In the embodiment shown in FIGS. 3 and 4, the base 210 further includes a flat plate 250 and a chamber 270 adjacent to one side of the flat plate 250, an accommodating cavity 280 is disposed inside the chamber 270, and the insertion slot 260 is formed at one side of the chamber 270 and communicates with the accommodating cavity 280. The insertion slot 260 is preferably in a shape fitted to a cross-sectional shape of the light emitting component 10, thereby also preventing incorrect insertion.

As shown in FIGS. 5 to 7, in order to enhance a waterproof effect or use the connector assembly outdoors or in a damp environment, a first waterproof rib 160 is surroundingly disposed on an end face of the body 120, and a first groove 158 corresponding to the first waterproof rib 160 is surroundingly formed on the cover 150, thereby preventing entry of moisture and prolonging a lifespan of the connector assembly 100. As shown in FIG. 5, the first waterproof rib 160 and the first groove 158 preferably have, but not limited to, a trapezoid shape.

The other side of the first waterproof rib 160, i.e. the wire groove 180, also has a waterproof design. To be specific, the wire groove 180 includes a first arch groove 182 disposed at the body 120 and a second arch groove 184 disposed at the cover 150. A plurality of waterproof embossed portions 194 are disposed on a surface of the first arch groove 182, and a plurality of recessed portions 192 corresponding to the waterproof embossed portions 194 are disposed on a surface of the second arch groove 184, wherein each waterproof embossed portions 194 and each recessed portions 192 can be interchanged, and the present invention is not limited in this regard. Therefore, the first pivot member 110 can provide the waterproof effect by means of the first waterproof rib 160/the first groove 158 and each waterproof embossed portion 194/each recessed portion 192.

Furthermore, a second waterproof rib 162 is surroundingly disposed on an edge of the chamber 270 of the second pivot member 200, and a second groove 164 corresponding to the second waterproof rib 162 is surroundingly disposed on the body 120. Therefore, when the first pivot member 110 rotates to be engaged with the second pivot member 200, the second waterproof rib 162 is engaged with the second groove 164 to prevent entry of the moisture into the accommodating cavity 280. The second waterproof rib 162 preferably has the same shape as the first waterproof rib 160; however, the present invention is not limited in this regard.

When the first pivot member 110 rotates about the second pivot portion 220 as axis to be engaged with the second pivot member 200, the piercing portion 330 in the through hole 132 rotates to pierce the light emitting component 10 in the accommodating cavity 280 so as to be electrically coupled with the flexible printed circuit board 40. At this point, the first pivot member 110 is engaged with the second protrusion 212 of the base 210 by means of the second fastener 128, thereby the connector assembly 100 bidirectionally clamps the wire 300 and the light emitting component 10 to electrically connect them. Similarly, when to take out the light emitting component 10, the user only needs to pull the second fastener 128 to be disengaged from the second protrusion 212 of the base 210 to take out the light emitting component 10 out from the insertion slot 260 of the second pivot member 200.

Figure 8:
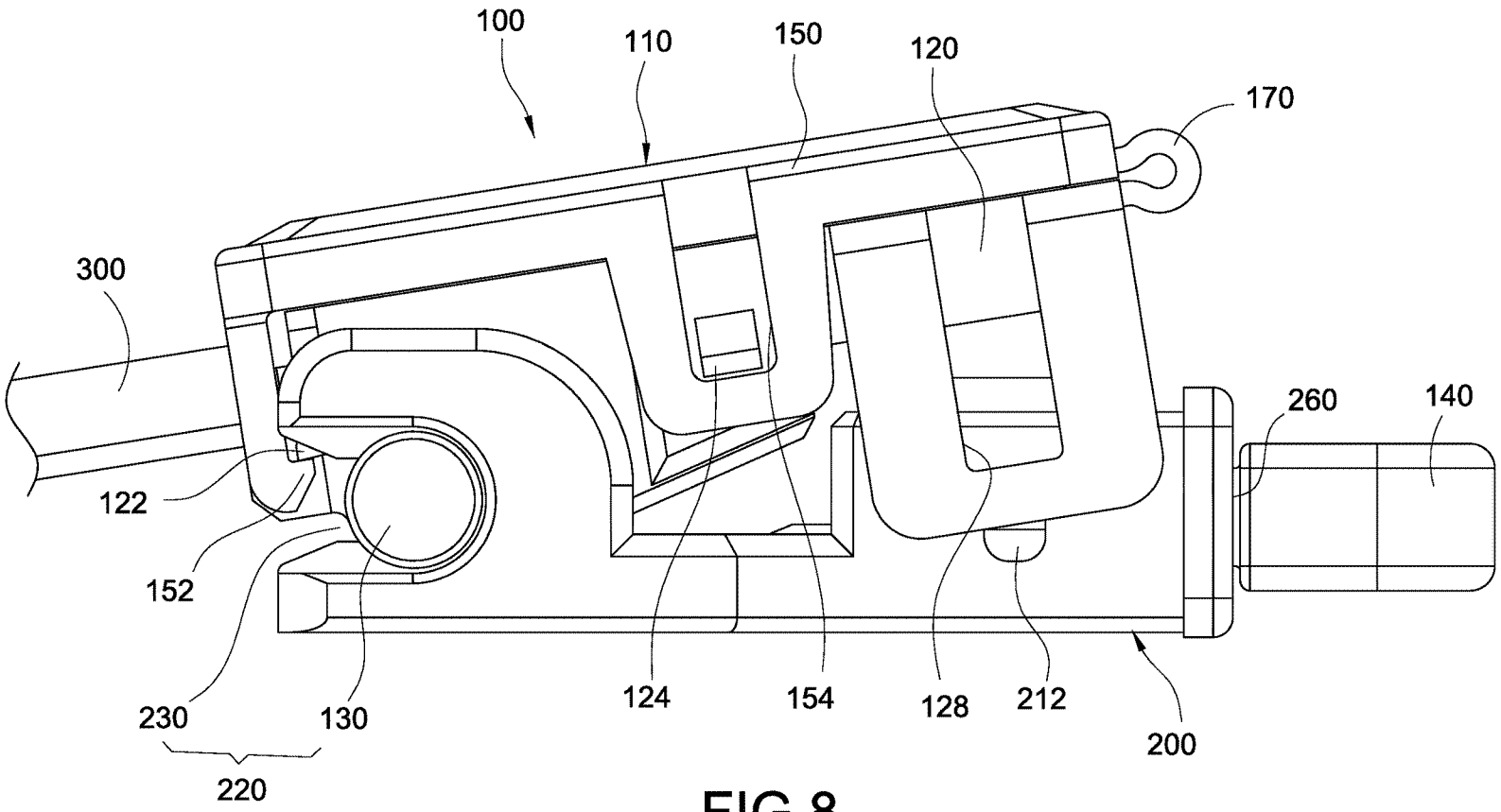
FIG. 8 is a lateral view of the present invention, illustrating that a plug is assembled to the connector assembly with the bidirectional clamping structure.

As shown in FIG. 8, the present embodiment further includes a plug 140 inserted into the insertion slot 260 to prevent the first pivot member 110 and the second pivot member 200 from accidental engagement before use of the connector assembly 100.

According to the present invention, the wire 300 is clamped in the wire groove 180 of the first pivot member 110 by means of the first pivot portion 170, and the first pivot member 110 covers and insertedly connects the light emitting component 10 of the second pivot member 200 by means of the second pivot portion 220, so that the electrical power of the wire 300 can be delivered to the flexible printed circuit board 40 of the light emitting component 10, thereby the light emitting diode 20 can light up.

Accordingly, it is easy and convenient to operate the connector assembly 100 for assembly, replacement, or maintenance of the light emitting component 10, thus saving time and cost for installation or maintenance. Furthermore, by means of the hook portion 152, the first fastener 154, and the second fastener 128 of the connector assembly 100, the connection reliability between the wire 300 and the light emitting component 10 is enhanced, thereby ensuring the stability of power delivery.

It is to be understood that the above descriptions are merely the preferable embodiments of the present invention and are not intended to limit the scope of the present invention. Equivalent changes and modifications made in the spirit of the present invention are regarded as falling within the scope of the present invention.

What is claimed is:

1. A connector assembly with a bidirectional clamping structure for assembling a light emitting component (10), the connector assembly (100) comprising:

a first pivot member (110) including a body (120), a cover (150), a first pivot portion (170) connected to one side of the body (120) and the cover (150), and a wire groove (180) formed at the other side of the body (120) and the cover (150), wherein the wire groove (180) is disposed corresponding to the first pivot portion (170); and a second pivot member (200) detachably pivotally connected to the first pivot member (110), the second pivot member (200) including a base (210), the base (210) including a second pivot portion (220) asymmetrically disposed with respect to the first pivot portion (170) and an insertion slot (260), wherein the insertion slot (260) is provided for insertion of the light emitting component (10) and is disposed corresponding to the other side of the second pivot portion (220).

2. The connector assembly with the bidirectional clamping structure of claim 1, wherein the second pivot portion (220) further includes two shafts (130) and two axle holes (230) receiving the two shafts (130), the two shafts (130) protrude from two sides of the body (120) respectively, and the two axle holes (230) are formed at two sides of the base (210) respectively.

3. The connector assembly with the bidirectional clamping structure of claim 2, wherein the base (210) further includes two holders (240), each of the axle holes (230) is formed at each of the holders (240), and an end portion of each of the holders (240) includes an engagement portion (242) sized smaller than a diameter of the axle hole (230).

4. The connector assembly with the bidirectional clamping structure of claim 1, wherein the cover (150) includes a hook portion (152) and a first fastener (154), and the body (120) includes a bump (122) engaged with the hook portion (152) and includes a first protrusion (124) engaged with the first fastener (154).

5. The connector assembly with the bidirectional clamping structure of claim 1, wherein a side surface of the body (120) includes a second fastener (128), and the base (210) includes a second protrusion (212) engaged with the second fastener (128).

6. The connector assembly with the bidirectional clamping structure of claim 1, wherein a first waterproof rib (160) is surroundingly disposed on an end face of the body (120), and a first groove (158) corresponding to the first waterproof rib (160) is surroundingly formed on the cover (150).

7. The connector assembly with the bidirectional clamping structure of claim 1, wherein the base (210) includes a flat plate (250) and a chamber (270) adjacent to one side of the flat plate (250), an accommodating cavity (280) is disposed inside the chamber (270), and the insertion slot (260) is formed at one side of the chamber (270) and communicates with the accommodating cavity (280).

8. The connector assembly with the bidirectional clamping structure of claim 7, wherein a second waterproof rib (162) is surroundingly disposed on an edge of the chamber (270), and a second groove (164) corresponding to the second waterproof rib (162) is surroundingly disposed on the body (120).

9. The connector assembly with the bidirectional clamping structure of claim 1, wherein the wire groove (180) includes a first arch groove (182) disposed at the body (120) and a second arch groove (184) disposed at the cover (150), a plurality of waterproof embossed portions (194) are disposed on a surface of the first arch groove (182), and a plurality of recessed portions (192) corresponding to the waterproof embossed portions (194) are disposed on a surface of the second arch groove (184).

10. The connector assembly with the bidirectional clamping structure of claim 1, further comprising a plug (140), the plug (140) being inserted into the insertion slot (260).

11. The connector assembly with the bidirectional clamping structure of claim 1, further comprising a wire (300) in the wire groove (180) and a conductive terminal (310) clamping the wire (300), the cover (150) including a press pillar (156) pressing the wire (300).

12. The connector assembly with the bidirectional clamping structure of claim 11, wherein the conductive terminal (310) includes at least one covering portion (320) and a piercing portion (330) disposed protrudingly, the at least one covering portion (320) covers the wire (300), and the piercing portion (330) pierces the light emitting component (10) to be electrically connected to the light emitting component (10).

* * * * *